US010851623B2

(12) United States Patent
Coffin et al.

(10) Patent No.: US 10,851,623 B2
(45) Date of Patent: Dec. 1, 2020

(54) SHUNT SYSTEM FOR DOWNHOLE SAND CONTROL COMPLETIONS

(71) Applicant: Halliburton Energy Services, Inc., Houston, TX (US)

(72) Inventors: Maxime Philippe Coffin, London (GB); Patrick Patchi Bourgneuf, Pau (FR); Andrew David Penno, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/541,360

(22) PCT Filed: Nov. 14, 2016

(86) PCT No.: PCT/US2016/061796
§ 371 (c)(1),
(2) Date: Jun. 30, 2017

(87) PCT Pub. No.: WO2018/052462
PCT Pub. Date: Mar. 22, 2018

(65) Prior Publication Data

US 2018/0266219 A1 Sep. 20, 2018

Related U.S. Application Data

(60) Provisional application No. 62/393,695, filed on Sep. 13, 2016.

(51) Int. Cl.
*E21B 43/08* (2006.01)
*E21B 43/02* (2006.01)
(Continued)

(52) U.S. Cl.
CPC ..... *E21B 43/088* (2013.01); *E21B 43/02* (2013.01); *E21B 43/04* (2013.01); *E21B 43/08* (2013.01);
(Continued)

(58) Field of Classification Search
CPC .... E21B 43/088; E21B 43/105; E21B 43/082; E21B 43/084
See application file for complete search history.

(56) References Cited

U.S. PATENT DOCUMENTS 7,708,068 B2 5/2010 Hailey, Jr.
7,984,760 B2 7/2011 Haeberle et al.
(Continued)

FOREIGN PATENT DOCUMENTS

WO 2010/120419 A1 10/2010

OTHER PUBLICATIONS

On Feb. 4, 2020 accessed definition of "mesh" via https://www.thefreedictionary.com/Wire+mesh. (Year: 2005).*
(Continued)

*Primary Examiner* — D. Andrews
*Assistant Examiner* — Manuel C Portocarrero
(74) *Attorney, Agent, or Firm* — McGuire Woods LLP

(57) ABSTRACT

A downhole sand control completion system includes a completion string extendable within a wellbore and including one or more sand control screen assemblies arranged about a base pipe, each sand control screen assembly including one or more sand screens positioned about the base pipe. A shunt system is positioned about an exterior of the base pipe to receive and redirect a gravel slurry flowing in an annulus defined between the completion string and a wellbore wall. A return tube is positioned about the exterior of the base pipe and extends longitudinally along a portion of the completion string. The return tube defines a plurality of
(Continued)

openings to receive a portion of a fluid in the annulus into the return tube to be conveyed into an interior of the base pipe via the return tube.

21 Claims, 7 Drawing Sheets

(51) Int. Cl.
*E21B 43/10* (2006.01)
*E21B 43/04* (2006.01)

(52) U.S. Cl.
CPC ..... *E21B 43/082* (2013.01); *E21B 43/10* (2013.01); *E21B 43/105* (2013.01); *E21B 43/084* (2013.01)

(56) References Cited

U.S. PATENT DOCUMENTS 8,833,445 B2 9/2014 Techentien et al.
2002/0125005 A1* 9/2002 Eslinger ..... E21B 23/006 166/250.17
2004/0140089 A1 7/2004 Gunneroed
2008/0314589 A1 12/2008 Guignard et al.
2012/0103608 A1 5/2012 Van Petegem et al.
2013/0048280 A1 2/2013 Techentien et al.
2014/0251609 A1* 9/2014 Broussard ..... E21B 43/04 166/278
2015/0285038 A1* 10/2015 Yeh ..... E21B 43/04 166/278

OTHER PUBLICATIONS

On Feb. 4, 2020, accessed definition of "mesh" via https://www.thefreedictionary.com/Wire+mesh (Year: 2005).*
International Search Report and Written Opinion for PCT/US2016/061796 dated Jun. 2, 2017.

* cited by examiner

SHUNT SYSTEM FOR DOWNHOLE SAND CONTROL COMPLETIONS

CROSS-REFERENCE TO RELATED APPLICATIONS

The present application is a National Stage entry of and claims priority to International Application No. PCT/US2016/061796, filed on Nov. 14, 2016, which claims priority to U.S. Provisional Patent App. Ser. No. 62/393,695, filed on Sep. 13, 2016 the entireties of each of which are incorporated herein by reference.

BACKGROUND

In producing hydrocarbons from subterranean formations, it is not uncommon to produce large volumes of particulate material (e.g., sand) along with fluids originating from the subterranean formation. The production of sand must be controlled or it may adversely affect the economic life of the well. One common technique used for sand control is known as "gravel packing."

In a typical gravel pack completion, well screens are positioned within the wellbore adjacent an interval to be completed and a gravel slurry is pumped down the well and into the annulus defined between the screens and the wellbore wall. The gravel slurry generally comprises relatively coarse sand or gravel suspended within water or a gel and acts as a filter to reduce the amount of fine formation sand reaching the well screens. As liquid is lost from the slurry into the formation or through the screens, the gravel from the slurry is deposited around the screens to form a permeable mass that allows produced fluids to flow through while substantially blocking the flow of particulates.

One common problem in gravel packing operations, especially in horizontal or inclined wellbores, is adequately distributing the gravel over the entire completion interval, and thereby completely packing the annulus along the length of the screens. Poor distribution of gravel (i.e., voids in the gravel pack) often results when liquid from the gravel slurry is lost prematurely into the more permeable portions of the formation, thereby resulting in "sand bridges" forming in the annulus before all of the gravel has been properly deposited. This phenomenon can also occur in formations having low fracture gradients where there is not enough margin between the pressures associated with the placement of such treatment and the fracture pressure of the formation, inducing significant leak off into the formation, which results in the formation of sand bridges. These sand bridges effectively block further flow of the gravel slurry within the annulus and prevent delivery of gravel to all parts of the annulus surrounding the screens.

One approach to avoiding an incomplete gravel pack has been to incorporate shunt tubes that longitudinally extend across the sand screens. Shunt tubes provide alternate flow paths that allow the inflowing gravel slurry to bypass any sand bridges or formation collapse that may be formed and otherwise transport the gravel slurry to the annulus downhole from forming sand bridges, thereby forming the desired gravel pack beneath it.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure generally relates to downhole fluid inflow control and, more particularly, to shunt systems used to distribute a gravel slurry in downhole completion systems and including a return tube operable to aid in dehydration of the gravel slurry.

The presently disclosed embodiments facilitate a more complete or enhanced sand face pack during gravel packing and/or formation fracture packing operations in conjunction with downhole completion systems that incorporate inflow control devices (ICD) or autonomous inflow control devices (AICD). The completion system includes a base pipe providing an interior and defining flow ports that provide fluid communication between the interior and an annulus defined between the completion system and a wellbore wall. One or more sand screens are positioned about the exterior of the base pipe and filter incoming fluids before conveying the fluids to one or more inflow control devices, which operate to regulate the flow of the incoming fluids. A shunt system is positioned about the base pipe to receive and redirect a gravel slurry flowing in the annulus. A return tube may be included in the shunt system and extends along all or a portion of the completion system. The return tube is designed to draw in fluids from the gravel slurry and convey the fluids to an end of the completion system where the fluids enter the base pipe for production to a well surface location. The return tube may prove advantageous in providing an alternate return path for fluids that bypass the restrictive inflow control devices. This may help dehydrate the gravel slurry more effectively and result in a more complete sand face pack.

Figure 1:
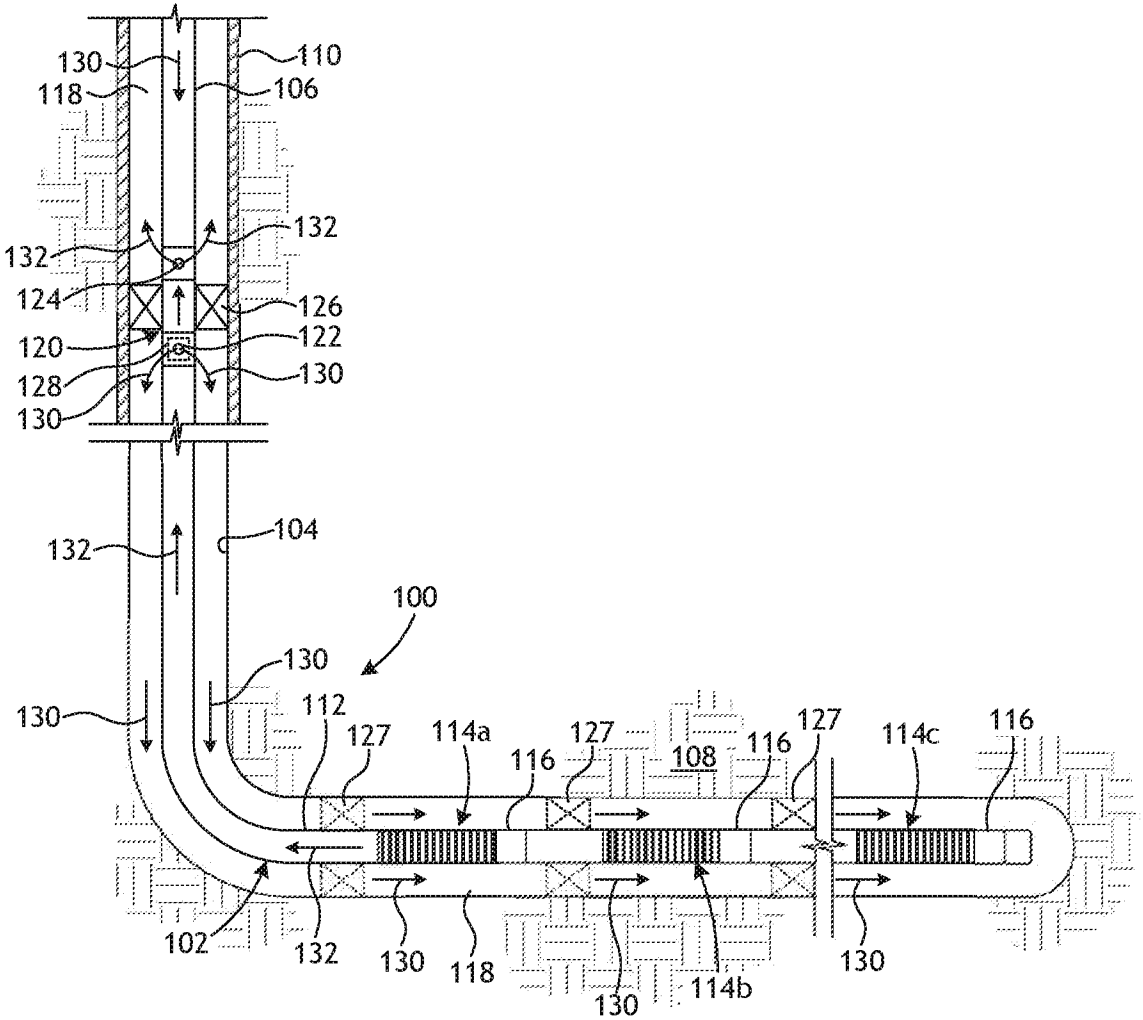
FIG. 1 is an example sand control completion system that can incorporate the principles of the present disclosure.

FIG. 1 depicts an example sand control completion system 100 that can incorporate the principles of the present disclosure, according to one or more embodiments. As illustrated, the sand control completion system 100 (hereafter the "system 100") may include a completion string 102 extendable into a wellbore 104 as coupled to a work string 106. In the illustrated embodiment, the wellbore 104 extends vertically and transitions into a horizontal section where some of the system 100 is located. Even though FIG. 1 depicts portions of the system 100 arranged in a horizontal section of the wellbore 104, those skilled in the art will readily recognize that the principles of the present disclosure are equally well suited for use in vertical, deviated, slanted, or uphill wellbores. Moreover, the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The wellbore 104 penetrates one or more hydrocarbon-bearing subterranean formations 108 and, in some embodiments, at least a portion of the wellbore 104 (e.g., the vertical portion) may be lined with a casing 110 and properly cemented therein, as known in the art. The horizontal portion of the wellbore 104 may remain encased such that the completion string 102 is extended into an "open-hole" portion of the wellbore 104. In other embodiments, however, the system 100 may be deployed for operation in a wellbore 104 lined entirely with casing 110, without departing from the scope of the disclosure.

The completion string 102 may include a base pipe 112 and a plurality of sand control screen assemblies axially spaced from each other along the base pipe 112 and shown as a first sand control screen assembly 114*a*, a second sand control screen assembly 114*b*, and a third sand control screen assembly 114*c*. While three sand control screen assemblies 114*a-c* are depicted in the system 100, it will be appreciated that more or less than three sand control screen assemblies 114*a-c* may be axially spaced along the completion string 102, without departing from the scope of the disclosure.

Each sand control screen assembly 114*a-c* includes one or more sand screens that comprise fluid-porous, particulate restricting devices made from a plurality of layers of a wire mesh that are diffusion bonded or sintered together to form a fluid porous wire mesh screen. In other embodiments, however, the sand screens may have multiple layers of a woven or non-woven wire metal mesh material having a uniform pore structure and a controlled pore size that is determined based upon the properties of the surrounding formation. For example, suitable woven wire mesh screens may include, but are not limited to, a plain Dutch weave, a twilled Dutch weave, a reverse Dutch weave, combinations thereof, or the like. In other embodiments, however, the sand screens may include a single layer of wire mesh, multiple layers of wire mesh that are not bonded together, a single layer of wire wrap, multiple layers of wire wrap or the like, that may or may not operate with a drainage layer. Those skilled in the art will readily recognize that several other sand screen designs are equally suitable.

Each sand control screen assembly 114*a-c* may also include a corresponding flow control device 116 used to restrict or otherwise regulate the flow of fluids into the base pipe 112 following filtration through the corresponding sand screen(s). In some embodiments, however, the flow control device 116 may be omitted from the third sand control screen assembly 114*c* near the toe of the wellbore 104, as will be discussed below. The flow control devices 116 may comprise, for example, inflow control devices (ICD), autonomous inflow control devices (AICD), or inflow control valves (ICV). An ICD is designed to exhibit a viscosity dependent fluid flow resistance in the form of a positive flowrate response to decreasing fluid viscosity. In contrast, an AICD is designed to exhibit a viscosity dependent fluid flow resistance in the form of a negative flowrate response to decreasing fluid viscosity. Flow changes through the ICD and/or the AICD can be a function of density and flow rate, in addition to viscosity. In some embodiments, the same ICD or AICD may exhibit a positive and a negative flowrate response depending on the flow regime. More particularly, a given ICD or AICD may exhibit a negative flow rate response for one combination of viscosity, flow rate, and density, but may exhibit a positive flow rate response for a different combination of viscosity, flow rate, and density, without departing from the scope of the disclosure. An ICV may comprise, for example, a valving component or mechanism that can be selectively actuated to partially or completely choke flow into production tubing. In at least one embodiment, for example, the ICV may comprise a sliding sleeve assembly that can be actuated to move between open and closed positions. The ICV can be controlled remotely or locally.

In operation, each sand control screen assembly 114*a-c* serves the primary function of filtering particulate matter out of fluids present within the annulus 118 defined between the completion string 102 and the inner wall of the wellbore 104 such that particulates and other fines are not produced to the surface. The fluids filtered by the sand control screen assemblies 114*a-c* either can originate from the surrounding formation 108 or may comprise fluids included in a gravel slurry into the annulus 118 during gravel packing operations. After passing through the sand screens, the flow control devices 116 operate to regulate the flow of the fluids into the base pipe 112. Regulating the flow of fluids into the base pipe 112 along the entire completion interval may be advantageous in preventing water coning or gas coning in the subterranean formation 108. Other uses for flow regulation of the fluids include, but are not limited to, balancing production from multiple production intervals, minimizing production of undesired fluids, maximizing or optimizing production of desired fluids, etc.

The system 100 may further include a crossover tool 120 that includes one or more circulation ports 122 (one shown) and one or more return ports 124 (one shown). The circulation and return ports 122, 124 may be isolated from each other in the wellbore 104 by a gravel pack packer 126 included in the crossover valve 120. More specifically, when deployed within the wellbore 104, the gravel pack packer 126 serves to isolate fluids ejected from the crossover valve 120 via the circulation port(s) 122 from fluids ejected from the crossover valve 120 via the return ports 122.

While the gravel pack packer 126 is depicted as being deployed in the wellbore 104 to sealingly engage the inner wall of the casing 110, the gravel pack packer 126 may alternatively be positioned to seal against the inner wall of an open-hole section of the wellbore, without departing from the scope of the disclosure. Moreover, while the gravel pack packer 126 is depicted as the one wellbore isolation device included in the system 100, it is further contemplated herein to include one or more isolation packers 127 (shown in dashed lines) deployed in the open hole section of the wellbore 104 and effectively isolating adjacent sand control screen assemblies 114*a-c*. In such embodiments, the presently disclosed shunt system and return tube described below may be configured to extend through the isolation packers 127 to provide fluid communication along the entire completions string 102. Use of the isolation packers 127 is optional based on design and application considerations.

Example operation of the system 100 is now provided to undertake hydraulic fracturing and/or gravel packing operations in the wellbore 104. Before producing hydrocarbons from the formation 108 penetrated by the completion string 102, it may be advantageous to hydraulically fracture the formation zone 108 in order to enhance hydrocarbon production. In other embodiments, however, especially in open-hole wellbores, it may not be necessary to undertake hydraulic fracturing operations. The annulus 118 below the gravel pack packer 126 may also be gravel packed to ensure limited sand production into the completion string 102 during production.

A service tool (not shown), also known as a gravel pack service tool is used to lower the completion string 102 into position, set the gravel pack packer 126 and undertake the hydraulic fracturing and/or gravel packing operations in the wellbore 104. The inner service tool may include one or more shifting tools used to open and close a circulating sleeve 128 of the circulation port(s) 122. During the gravel packing process a gravel slurry is pumped down the work string 106 and discharged into the annulus 118 below the gravel pack packer 126 via the circulation port(s) 122, as indicated by the arrows 130. The gravel slurry 130 may include, but is not limited to, a carrier fluid and particulate material such as gravel or proppant. In some cases, a viscosifying agent and/or one or more additives may be added to the carrier fluid. The gravel slurry 130 gradually builds in the annulus 118 and begins to form an annular "sand face" pack as fluids 132 (including a portion of the carrier fluid) are drawn back into the completion string 102 via the sand control screen assemblies 114*a-c*. The sand face pack and the sand control screen assemblies 114*a-c* cooperatively operate to prevent the influx of sand, gravel, proppant, and/or other particulates during gravel packing and production operations.

After passing through the sand screens of the sand control screen assemblies 114, a fluid 132 is conveyed to the flow control devices 116, which regulate the flow of the fluid 132 into the base pipe 112. Once in the base pipe 112, the fluid 132 may locate and enter a wash pipe (not shown) positioned within the interior of the base pipe 112 and fluidly coupled to the return port(s) 124. The fluid 132 circulates within the wash pipe until locating the return port(s) 124, where the fluid 132 is discharged into the annulus 118 above the gravel pack packer 126. The fluid 132 then circulates back to the well surface within the annulus 118 above the gravel pack packer 126.

Figure 2A:
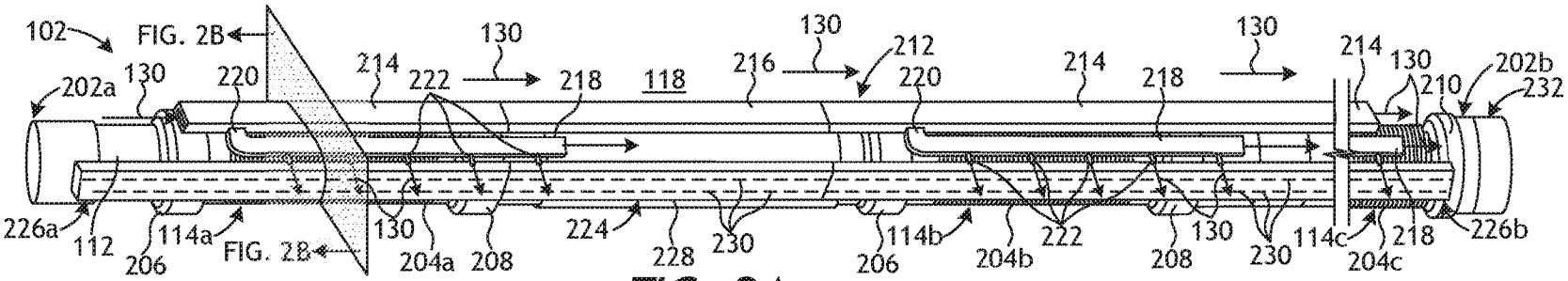
FIG. 2A is an isometric view of an example embodiment of the completion string of FIG. 1.

FIG. 2A is an isometric view of an example embodiment of the completion string 102, according to one or more embodiments of the present disclosure. As illustrated, the completion string 102 includes the base pipe 112 having a first or upper end 202*a* and a second or lower end 202*b*. The sand control screen assemblies 114*a-c* are depicted as included in the completion string (only a portion of the third sand control screen assembly 114*c* is shown). Each sand control screen assembly 114*a-c* may include at least one sand screen arranged about the base pipe 112 and depicted as a first sand screen 204*a*, a second sand screen 204*b*, and a third sand screen 204*c*. The sand screens 204*a-c* may be similar to the sand screens described above with reference to FIG. 1 and, therefore, may each comprise a fluid-porous, particulate restricting device made from one or more wires wrapped or meshed about the base pipe 112. In the illustrated embodiment, the first and second sand screens 204*a,b* extend axially between an upper end ring 206 and a flow control module 208, and a portion of the base pipe 112 (e.g., a screen joint) extends between the flow control module 208 of the first sand screen 204*a* and the upper end ring 206 of the second sand screen 204*b*. While not shown, the third sand screen 204*c* may extend between an upper end ring (not shown) and a lower end ring 210. In some embodiments, however, the lower end ring 210 of the third sand screen 204*c* may be replaced with a flow control module 208, without departing from the scope of the disclosure.

The completion string 102 may further include a shunt system 212 used to help ensure a complete sand face pack is achieved in the annulus 118 while gravel packing about the completion string 102. In the illustrated embodiment, the shunt system 212 is positioned on the exterior of the first and second sand screens 204*a,b* and includes a plurality of transport tubes 214 interconnected by jumper tubes 216 that extend across screen joints to fluidly couple axially adjacent transport tubes 214. In some embodiments, as illustrated, the shunt system 212 may further include one or more packing tubes 218 extending from each transport tube 214. In other embodiments, however, the packing tubes 218 may be omitted, without departing from the scope of the disclosure.

Each of the transport tubes 214, the jumper tube(s) 216, and the packing tubes 218 may comprise tubular conduits configured to transport the gravel slurry 130 to lower locations within the annulus 118. In some embodiments, as illustrated, each of the transport tubes 214, the jumper tube(s) 216, and the packing tubes 218 may comprise generally rectangular tubes or conduits. In other embodiments, however, one or more of the transport tubes 214, the jumper tube(s) 216, and the packing tubes 218 may exhibit other cross-sectional shapes such as, but not limited to, circular, oval, square, or other polygonal shapes.

The first or uppermost transport tube 214 may be coupled to or otherwise secured near the upper end ring 206 of the first sand screen 204*a* and extend axially along all or a portion of the first sand screen 204*a*. The last or lowermost transport tube 214 may similarly extend along all or a portion of the third sand screen 204*c*. The jumper tube(s) 216 operatively couples and facilitates fluid communication between axially adjacent transport tubes 214 across each screen joint.

If included, the packing tubes 218 may be coupled to the transport tubes 214 at flow junctions 220 extending from the transport tubes 214. The flow junctions 220 facilitate fluid communication between the transport tubes 214 and the corresponding packing tubes 218, respectively, such that a portion of the gravel slurry flowing within the transport tubes 214 may be transferred to the packing tubes 218 for discharge into the annulus 118. In the illustrated embodiment, the packing tubes 218 may extend substantially parallel to the transport tubes 214, but may alternatively extend at an angle offset from parallel, without departing from the scope of the disclosure.

In some embodiments, as illustrated, the packing tubes 218 may include one or more orifices 222 defined in a sidewall of the packing tubes 218. In at least one embodiment, as illustrated, the orifices 222 may comprise nozzles (e.g., pipes, tubes, etc.) that extend laterally from the sidewall of the packing tubes 218. The orifices 222 may facilitate discharge the gravel slurry 130 from the packing tubes 218 into the surrounding annulus 118. In other embodiments, or in addition thereto, the gravel slurry 130 may be discharged from the distal ends of one or both of the packing tubes 218, which may be open to the annulus 118.

According to embodiments of the present disclosure, the shunt system 212 may further include a return tube 224 that provides an alternate return path for fluids, which helps facilitate a more complete sand pack in the annulus 118. The return tube 224 extends longitudinally across all or substantially all of the entire length of the completion string 102 within the annulus 118. As illustrated, the return tube 224 may provide a first or upper end 226*a* positioned uphole from all of the sand screens 204*a-c* in the completion string 102, and a second or lower end 226*b* that is positioned downhole from all of the sand screens 204*a-c*. In other embodiments, however, the upper end 226*a* need not be positioned uphole from the first sand screen 204*a*, but may alternatively be positioned along the axial length of the first sand screen 204*a* (i.e., between the upper end ring 206 and the flow control module 208 of the first sand screen 204*a*) or downhole from the first sand screen 204*a*, without departing from the scope of the disclosure. In at least one embodiment, the return tube 224 is positioned such that it extends across multiple sand screens 204*a-c* and any interposing screen joints comprising blank pipe sections.

In some embodiments, as illustrated, the return tube 224 may include one or more jumper tubes 228 (one shown) that fluidly couples axially adjacent portions of the return tube 224. Similar to the jumper tube(s) 216, the jumper tube(s) 228 is configured to generally span the axial distance between axially adjacent screens 204*a-c* and otherwise across screen joints. Accordingly, depending on the number of screens 204*a-c* included in the completion string 102, the return tube 224 may include several jumper tubes 228. In other embodiments, however, the jumper tube(s) 228 may be omitted and the return tube 224 may alternatively extend as a monolithic (continuous) conduit between its first and second ends 226*a,b*. Similar to the transport tubes 214 and the packing tubes 218, the return tube 224 may comprise a generally rectangular tube or conduit, but could alternatively exhibit other cross-sectional shapes such as, but not limited to, circular, oval, square, or other polygonal shapes.

A plurality of openings 230 may be provided and otherwise defined in the return tube 224 along all or a portion of its length to allow fluid communication between the annulus 118 and the interior of the return tube 224. In some applications, the openings 230 may also help fluid communication between the return tube 224 and the underlying screens 204*a-c*. More specifically, the gravel packing takes place around the screens 204*a-c* and the carrier fluid from the gravel slurry will dehydrate into the screens 204*a-c*. When trying to flow the carrier fluid through a flow control device (e.g., an inflow control device), however, the pressure could be such that a portion of the carrier fluid is forced to exit the screens 204*a-c* and enter the return tube 204 via the openings 230.

The openings 230 may be sized and otherwise dimensioned to allow fluids to flow therethrough, but prevent passage of particulate matter of a predetermined size. Consequently, the openings 230 may be configured to allow a carrier fluid of the gravel slurry 130 to pass into the return tube 224, but prevent proppant, sand, gravel, and other solid particulate from the gravel slurry 130 and the surrounding formation 108 (FIG. 1) from entering the return tube 224. In some embodiments, some or all of the openings 230 may be in the form of slots, but could alternatively comprise any other shape, dimension, or means of filtration of such solid particulates.

The openings 230 may be formed in the return tube 224 using any known manufacturing technique including, but not limited to, laser cutting, water jetting, machining, or any combination thereof. In at least one embodiment, the return tube 224 may comprise an elongate sand screen structure where the openings 230 are formed and otherwise provided between laterally adjacent wires of the sand screen structure.

The second end 226*b* of the return tube 224 may be positioned (terminated) at a predetermined location between the upper and lower ends 202*a,b* of the base pipe 112. In the illustrated embodiment, for example, the predetermined location may be a completion end 232 of the completion string 102. In such embodiments, the second end 226*b* of the return tube 224 may terminate and he fluidly coupled to the base pipe 112 at the completion end 232, which may be located at or near the lowermost or distal end of the completion string 102 and, therefore, located at or near the toe (bottom) of the wellbore 104 (FIG. 1). In other embodiments, however, the second end 226*b* of the return tube 224 may terminate and be fluidly coupled to the base pipe 112 uphole from the completion end 232, such as at a location where one or more additional sand control screen assemblies interpose the second end 226*b* and the completion end 232. Accordingly, the predetermined location where the return tube 224 is positioned (terminates) may be an intermediate location between the upper and lower ends 202*a,b*, and not necessarily at or near the completion end 232, without departing from the scope of the disclosure.

One or more of the transport tubes 214, the jumper tubes 216, the packing tubes 218, the orifices 222, and the return tube 224 may be erosion-resistant or otherwise made of an erosion-resistant material. Suitable erosion-resistant materials include, but are not limited to, a carbide (e.g., tungsten, titanium, tantalum, or vanadium), a carbide embedded in a matrix of cobalt or nickel by sintering, a cobalt alloy, a ceramic, a surface hardened metal (e.g., nitrided metals, heat-treated metals, carburized metals, hardened steel, etc.), a steel alloy (e.g. a nickel-chromium alloy, a molybdenum alloy, etc.), a cermet-based material, a metal matrix composite, a nanocrystalline metallic alloy, an amorphous alloy, a hard metallic alloy, or any combination thereof.

In other embodiments, or in addition thereto, one or more of the transport tubes 214, the jumper tube 216, the packing tubes 218, the orifices 222, and the return tube 224 may be made of a metal or other material that is internally clad or coated with an erosion-resistant material such as, such as tungsten carbide, a cobalt alloy, or ceramic. Cladding with the erosion-resistant material may be accomplished via any suitable process including, but not limited to, weld overlay, thermal spraying, laser beam cladding, electron beam cladding, vapor deposition (chemical, physical, etc.), any combination thereof, and the like.

Figure 2B:
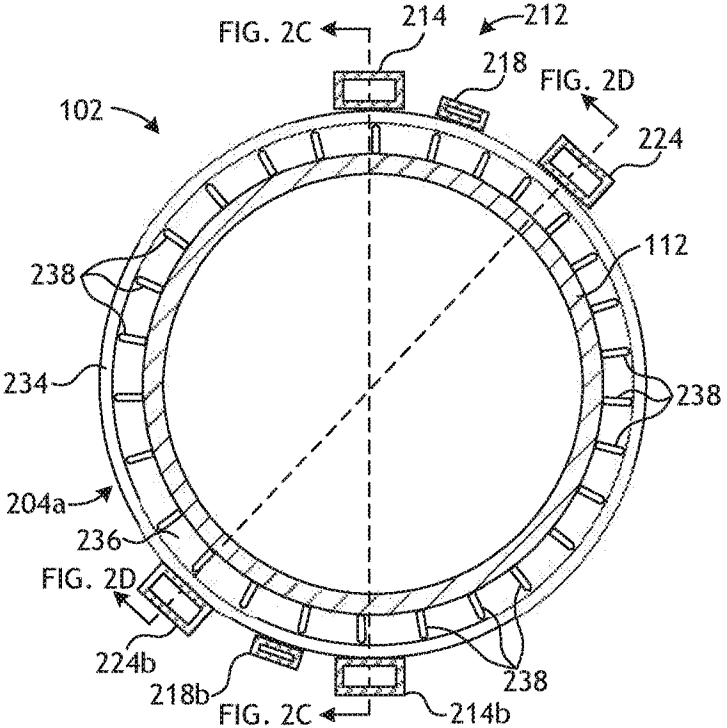
FIG. 2B is a cross-sectional end view of the completion string of FIG. 2A as taken along the plane indicated in FIG. 2A.

FIG. 2B is a cross-sectional end view of the completion string 102 as taken along the plane indicated in FIG. 2A. In FIG. 2B, the first sand screen 204*a* and an upper portion of the shunt system 212 are shown. As illustrated, the first sand screen 204*a* may include at least one wire 234 wrapped about the circumference of the base pipe 112 a plurality of turns (windings) or otherwise forming a mesh. A void or flow gap results between each laterally adjacent turn of the wire 234 through which fluids may penetrate the first sand screen 204*a*. The wire 234 may be radially offset from the base pipe 112, thereby defining a flow annulus 236 between the base pipe 112 and the wire 234. The radial offset is caused by a plurality of ribs 238 extending longitudinally along the outer surface of the base pipe 112. The dimensions of the flow annulus 236 largely depend on the height of the ribs 238. As illustrated, the ribs 238 are angularly spaced from each other about the circumference of the base pipe 112. In some embodiments, the ribs 238 exhibit a generally triangular cross-section, but may alternatively exhibit other cross-sectional geometries including, but not limited to, rectangular and circular cross-sections.

The shunt system 212 is depicted as including the transport tube 214, the packing tube 218, and the return tube 224 angularly offset from each other about the periphery of the first sand screen 204*a*. The shunt system 212 may further include another set of transport, packing, and return tubes, shown in FIG. 2B as a second transport tube 214*b*, a second packing tube 218*b*, and a second return tube 224*b*. In the illustrated embodiment, the transport and packing tubes 214, 218 and the return tube 224 are positioned diametrically opposite the second transport and packing tubes 214*b*, 218*b* and the second return tube 224*b* about the circumference of the base pipe 112. In other embodiments, however, the transport and packing tubes 214, 218 and the return tube 224 may be angularly offset only a short distance from the second transport and packing tubes 214*b*, 218*b* and the second return tube 224*b* about the circumference of the base pipe 112. Moreover, while two sets of transport, packing, and return tubes are depicted in FIG. 2B, it will be appreciated that the shunt system 212 may include more than two sets of transport, packing, and return tubes and the multiple sets may be equidistantly or non-equidistantly positioned about the circumference of the base pipe 112.

Figure 2C:
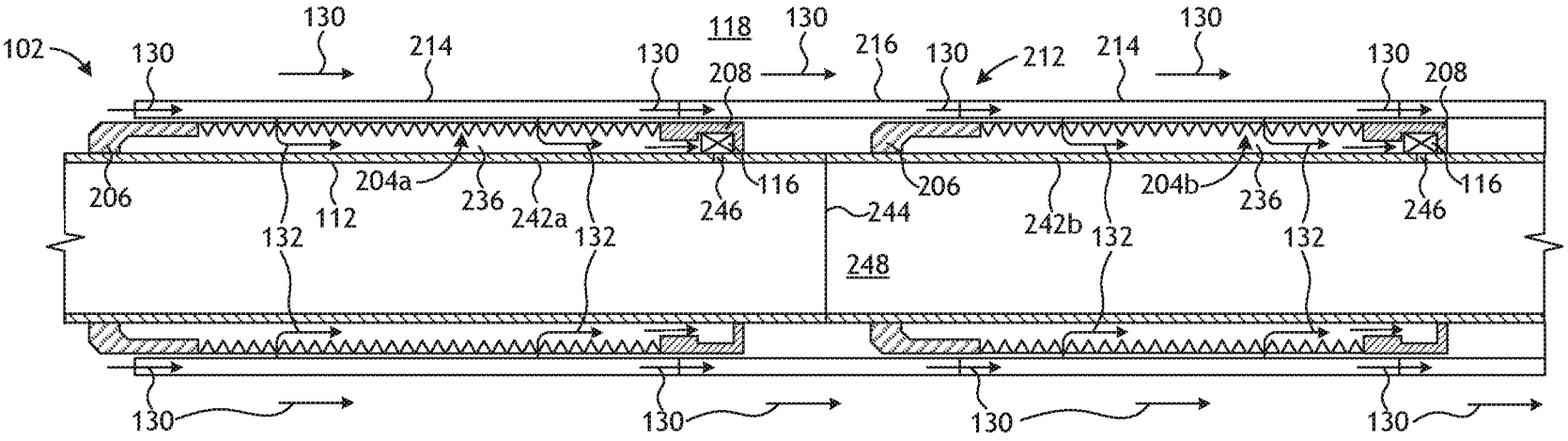
FIG. 2C is a cross-sectional side view of the completion string of FIG. 2A as taken along the lines FIG. 2C-FIG. 2C indicated in FIG. 2B.

FIG. 2C is a cross-sectional side view of the completion string 102 as taken along the lines FIG. 2C-FIG. 2C indicated in FIG. 2B. In FIG. 2C, the base pipe 112 is depicted as including an upper base pipe portion 242*a* and a lower base pipe portion 242*b* coupled at a joint 244, such as a threaded joint that threadably couples the upper and lower base pipe portions 242*a,b*. As illustrated, the first and second sand screens 204*a,b* extend between the upper end rings 206 and the flow control modules 208 along the axial length of the base pipe 112 and the flow annulus 236 is defined therebetween. Each flow control module 208 houses at least one flow control device 116. As described above, the flow control devices 116 may be used to restrict or otherwise regulate the flow of fluids into the base pipe 112 following filtration through the sand screens 204*a,b* and, as mentioned above, may comprise inflow control devices (ICD), autonomous inflow control devices (AICD), or inflow control valves (ICV).

One or more flow ports 246 are defined in the base pipe 112 and configured to provide fluid communication between the surrounding annulus 118 and an interior 248 of the base pipe 112 via the flow control devices 116. In contrast to other downhole systems requiring the use of a perforated base pipe, which includes multiple perforations distributed along the entire axial length of a base pipe, the flow ports 246 in the completion string 102 are defined generally at a single axial location along the base pipe 112. More specifically, at the single axial location, there may be a plurality of flow ports 246 angularly offset from each other at a single axial location, but there could alternatively be additional flow ports axially spaced from each other within a generalized single axial location, without departing from the scope of the disclosure. Accordingly, influx of fluids into the interior 248 may be facilitated only at one generalized axial location along the base pipe 112, and the fluids must therefore traverse the axial length of the flow annulus 236 until circulating through the flow control devices 116 and subsequently locating the flow ports 246 at the single axial location.

Figure 2D:
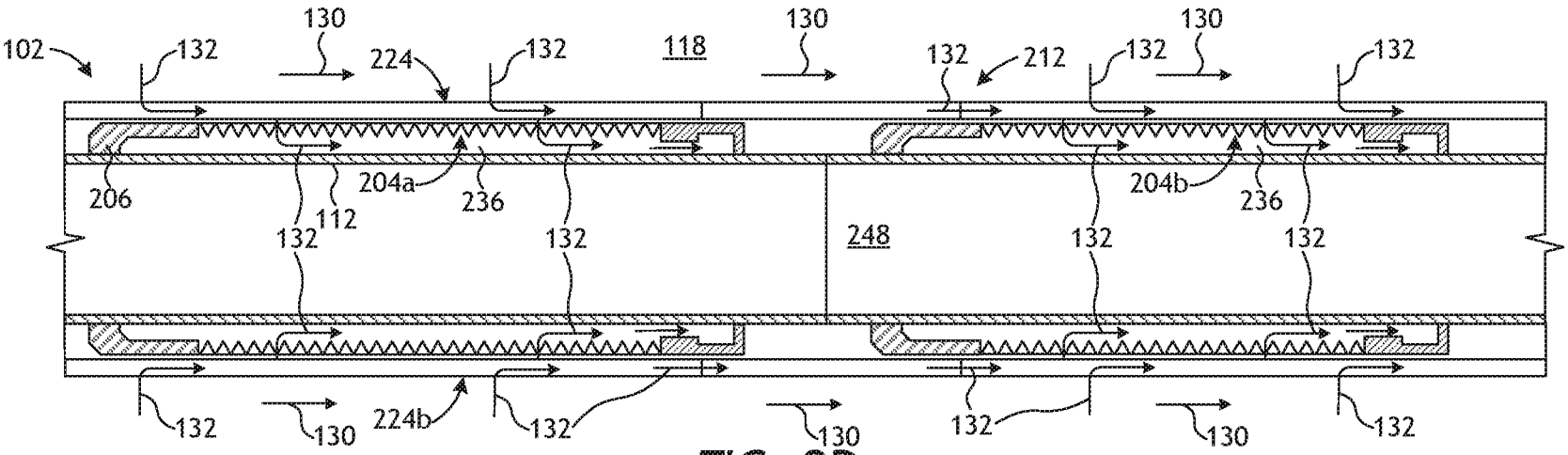
FIG. 2D is another cross-sectional side view of the completion string of FIG. 2A as taken along the lines FIG. 2D-FIG. 2D indicated in FIG. 2B.

FIG. 2D is another cross-sectional side view of the completion string 102 as taken along the lines FIG. 2D-FIG. 2D indicated in FIG. 2B. In FIG. 2D, the angularly opposite return tubes 224, 224*b* are depicted as extending along the exterior of the base pipe 112 and extending uphole and downhole along the axial length of the completion string 102.

Example operation of the completion string 102 is now provided with reference to FIGS. 2A, 2C, and 2D. The gravel slurry 130 is introduced into the annulus 118, as indicated by the arrows, and may generally flow in a downhole direction (i.e., to the right in FIGS. 2A, 2C, and 2D) within the annulus 118. As described above, the gravel slurry 130 may be introduced into the annulus 118 from the circulation ports 122 (FIG. 1) provided in the crossover valve 120 (FIG. 1). The gravel slurry 130 may gradually fill the annulus 118 and, over time, one or more sand bridges or the like may form in the annulus 118, thereby preventing the gravel slurry 130 from proceeding further downhole within the annulus 118. When sand bridges are formed, the shunt system 212 may prove useful in bypassing the sand bridges and otherwise redirecting the gravel slurry 130 to the remaining un-filled portions of the annulus 118.

As shown in FIGS. 2A and 2C, the first or uppermost transport tube 214 is open at its uphole end to receive and convey a portion of the gravel slurry 130 to the remaining transport tubes 214 via the jumper tube(s) 216. In some embodiments, the uphole end of the first transport tube 214 may be positioned uphole from the first sand screen 204*a* and radially adjacent a blank pipe (not shown) operatively coupled to the upper end 202*a* of the base pipe 112. As the gravel slurry 130 flows within the transport tubes 214, as shown in FIG. 2A, the gravel slurry 130 is able to flow into the packing tubes 218, which split off the transport tubes 214 at the flow junctions 220. The gravel slurry 130 may then be discharged from the packing tubes 218 and into the annulus 118 via the orifices 222. Alternatively, or in addition thereto, the gravel slurry 130 may also be discharged from the ends of the packing tubes 218 and the end of the transport tube 214, each of which may be open to the annulus 118.

As show in FIGS. 2C and 2D, during the gravel packing operations, a fluid 132 may be extracted from the gravel slurry 130 and drawn into the interior 248 of the base pipe 112 via the sand screens 204*a,b*. As discussed above, the fluid 132 may comprise carrier fluids separated from the gravel slurry 130 or any other fluids present in the annulus 118. As indicated by the arrows, the fluid may flow through the sand screens 204*a,b* and into the flow annulus 236. The fluid 132 then flows axially within the flow annulus 236 until locating the flow control devices 116 (FIG. 2C) arranged within corresponding flow control modules 208. After circulating through the flow control devices 116, the fluid 132 is then discharged into the interior of the base pipe 112 via the flow ports 246.

During the gravel packing operation, flow of the fluid 132 advances through the screens 204*a-c* as the gravel pack progresses. Having the flow control devices 116 in the return flow path, however, restricts the fluid flow, which could jeopardize the gravel pack placement. More specifically, circulating the fluid 132 through the flow control devices 116 may result in excessive back pressure, which could fracture the surrounding subterranean formations and also generate an incomplete gravel pack. According to the present disclosure, the return tube 224 (and return tube 224*b*, if used) provide an alternate return path for the fluid 132 that does not circulate through the restrictive flow control devices 116.

In FIG. 2D, a portion of the fluid 132 is shown passing into the return tubes 224, 224*b* from the annulus 118 and circulating downhole (i.e., to the right in FIG. 2D). As discussed above, the fluid 132 can enter the return tubes 224,

224*b* via the openings 230 (FIG. 2A) defined in each return tube 224, 224*b*. The openings 230 are sized to allow the fluid 132 to pass into the return tubes 224, 224*b*, but small enough to prevent the passage of particulate matter of a predetermined size from the gravel slurry 130 or the surrounding formation 108 (FIG. 1). In some embodiments, the return tubes 224, 224*b* convey the fluid 132 to the completion end 232 (FIG. 2A) where the fluid 132 is able to enter the interior 248 of the base pipe 112 without having to circulate through the restrictive flow control devices 116.

Figure 3A:
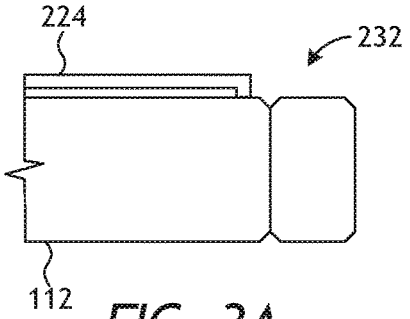
FIGS. 3A and 3B are side and cross-sectional side views, respectively, of an example embodiment of the completion end of FIG. 2A.
Figure 3B:
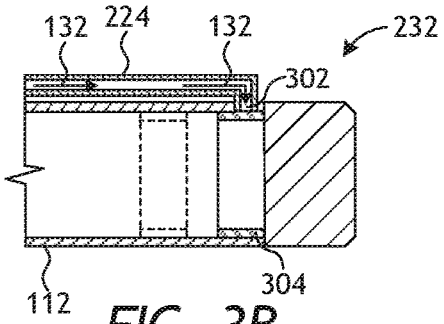

FIGS. 3A and 3B are side and cross-sectional side views, respectively, of an example embodiment of the completion end 232, according to one or more embodiments. As illustrated, the return tube 224 extends axially along the exterior of the base pipe 112 until terminating at or near the completion end 232. The completion end 232 may include, for example, a bullnose, a float shoe, or a casing shoe, as known to those skilled in the art.

In FIG. 3B, the fluid 132 is shown circulating through the return tube 224, which is coupled to and otherwise fluidly communicates with the base pipe 112 at a return port 302 defined in the base pipe 112. In the illustrated embodiment, the completion end 232 may also include an isolation sleeve 304 movably positioned within the base pipe 112 between open and closed positions. When in the closed position, as illustrated, the isolation sleeve 304 occludes the return port 302 and thereby prevents fluid communication between the return tube 224 and the interior 248. In the open position (shown in dashed lines), however, the isolation sleeve 304 moves axially within the interior 248 to expose the return port 302 and thereby allow the fluid 132 to flow into the interior 248 as it is discharged from the return tube 224.

The isolation sleeve 304 may be moved between the open and closed positions using an inner service tool with one or more shifting tools configured to engage and move the production sleeve isolation sleeve 304. In other embodiments, the isolation sleeve 304 may be moved between the open and closed positions using any type of actuator such as, but not limited to, a mechanical actuator, an electric actuator, an electromechanical actuator, a hydraulic actuator, a pneumatic actuator, or any combination thereof. In yet other embodiments, the isolation sleeve 304 may be moved between the open and closed positions by being acted upon by one or more wellbore projectiles (not shown), or by assuming a pressure differential within the interior 248 of the base pipe 112. During gravel packing operations, the isolation sleeve 304 will generally be in the open position to allow the return tube 224 to help dehydrate the gravel slurry 130 (FIGS. 2A, 2C, and 2D). Once the gravel packing operation is complete, however, the isolation sleeve 304 may be moved to the closed position to prevent production fluids from entering the interior 248 via the return tube 224. Instead, any production fluids will have to circulate through the flow control devices 116 (FIG. 2C) to access the interior 248.

Figure 4A:
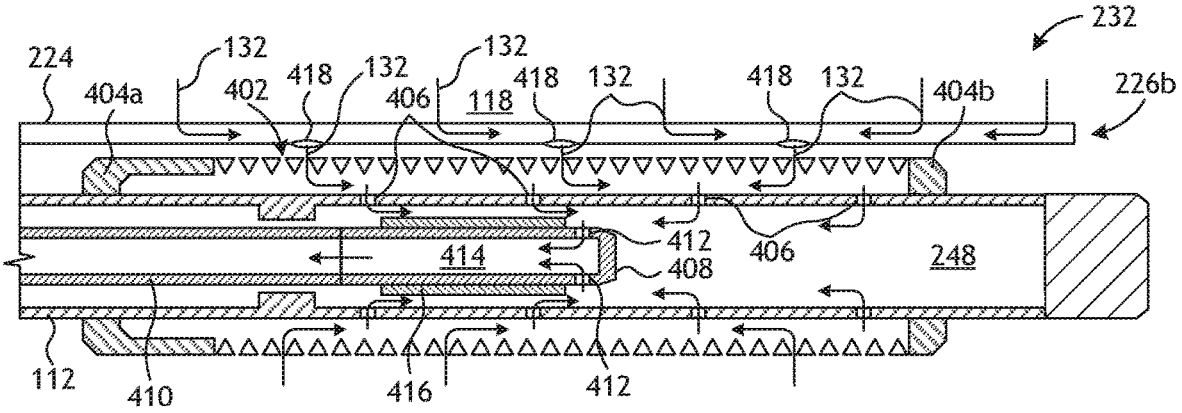
FIGS. 4A and 4B are cross-sectional side views of another example embodiment of the completion end of FIG. 2A.
Figure 4B:
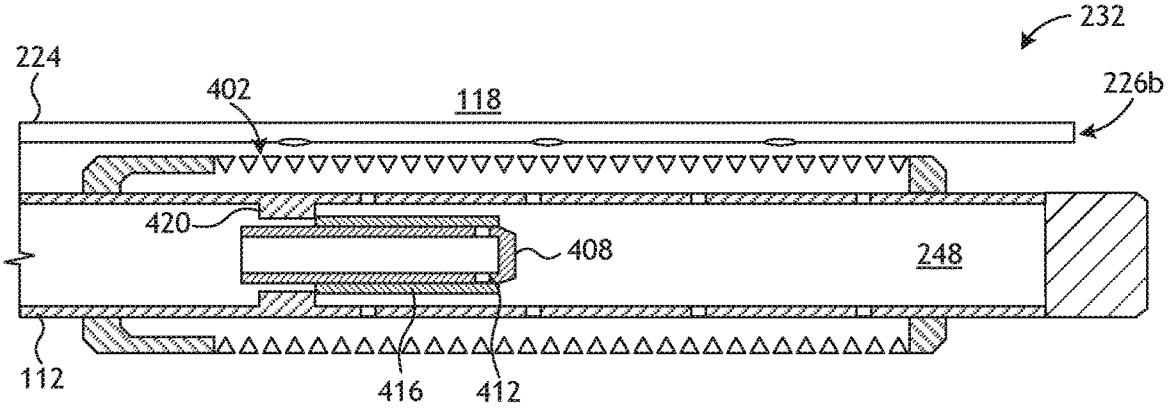

FIGS. 4A and 4B are cross-sectional side views of another example embodiment of the completion end 232, according to one or more embodiments. As illustrated in FIG. 4A, the return tube 224 extends axially along the exterior of the base pipe 112 until terminating at or near the completion end 232. In the illustrated embodiment, the distal end 226*b* of the return tube 224 may be capped or otherwise blanked off such that fluid flow out distal end 226*b* is prevented. Moreover, in the illustrated embodiment, the completion end 232 may include a sacrificial sand screen 402, which may be the same as or similar to the third sand screen 204*c* shown in FIG. 2A except the sacrificial sand screen 402 will not include a flow control device (i.e., the flow control device 116 of FIGS. 2C and 2D). As illustrated, the sacrificial sand screen 402 is positioned about the base pipe 112 and extends between an upper end ring 404*a* and a lower end ring 404*b* (e.g., the lower end ring 210 of FIG. 2A). In some embodiments, a plurality of return ports 406 may be defined in the base pipe 112 along the axial length of the sacrificial sand screen 402 to enable fluid communication between the interior 248 and the surrounding annulus 118

An isolation plug 408 may be positioned within the base pipe 112 at or near the completion end 232. The isolation plug 408 may be operatively and fluidly coupled to a wash pipe 410 or other tubular that enables fluid communication to the well surface. The isolation plug 408 may provide and otherwise define one or more flow ports 412 that provide fluid communication between the interior 248 of the base pipe 112 and an interior 414 of the isolation plug 408. The isolation plug 408 may also include a closure device 416 configured to selectively occlude the flow ports 412 and thereby cease flow of fluids into the interior 414 of the isolation plug 408. In the illustrated embodiment, for example, the closure device 416 is depicted as a sliding sleeve movably arranged about the exterior of the isolation plug 408. In operation, the sliding sleeve may be movable axially along the exterior of the isolation plug 408 to occlude the flow ports 412.

During gravel packing operations, the fluid 132 flows into the return tube 224 and is conveyed toward the completion end 232, as generally described above. At or near the distal end 226*b* of the return tube 224, the fluid 132 may be able to escape the return tube 224 via one or more discharge ports 418 provided or otherwise defined on the underside of the return tube 224. The fluid 132 discharged from the return tube 224 via the discharge ports 418 may be drawn into the sacrificial screen 402 and enter the interior 248 of the base pipe 112 via the return ports 406. Once in the interior 248, the fluid 132 may circulate into the isolation plug 408 via the flow ports 412 and be conveyed into the wash pipe 410 for production to the well surface.

In FIG. 4B, once the gravel packing operation is complete, the isolation plug 408 may be moved within the interior 248 to occlude the flow ports 412 and thereby cease the influx of the fluid 132 (FIG. 4A) into the interior 248 at the sacrificial screen 402. More specifically, the wash pipe 410 (FIG. 4A) may be used to axially move the isolation plug 408 in the uphole direction (i.e., to the left in FIGS. 4A and 4B), and thereby engage the closure device 416 on a radial protrusion 420 defined within the base pipe 112. Engaging the radial protrusion 420 will urge the closure device 416 to move along the exterior of the isolation plug 408 and eventually occlude the flow ports 412. Engaging the closure device 416 on the radial protrusion 420 may also generate a sealed interface between the two structures. Once the flow ports 412 are occluded, flow of the fluid 132 from the return tube 224 and into the base pipe 112 via the sacrificial screen 402 will effectively cease. This isolates the sacrificial screen 402. In some embodiments, the wash pipe 410 (FIG. 4A) may then be detached from the isolation plug 408 and returned to the surface location while the isolation plug 408 remains within the base pipe 112.

Figure 5A:
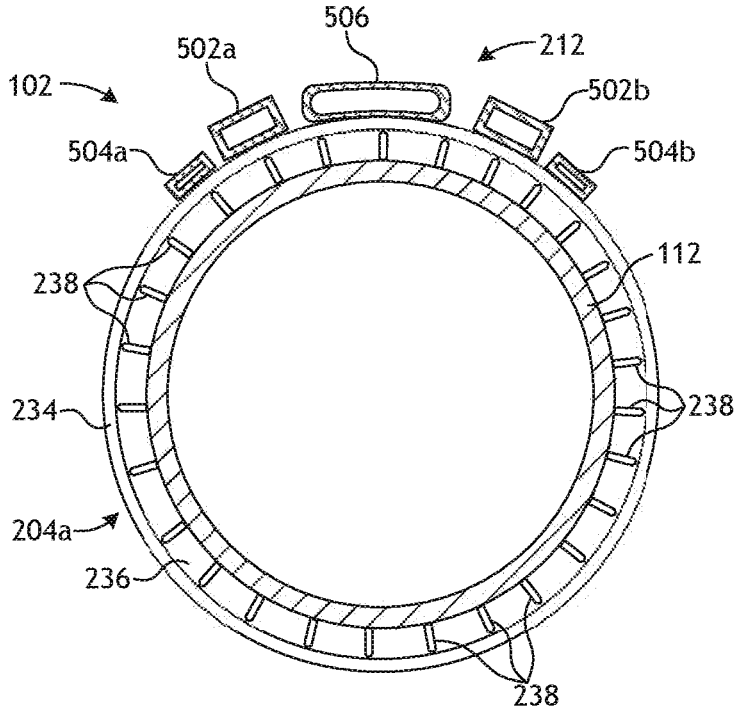
FIGS. 5A-5C are cross-sectional end views of example embodiments of the completion string of FIG. 2A.
Figure 5B:
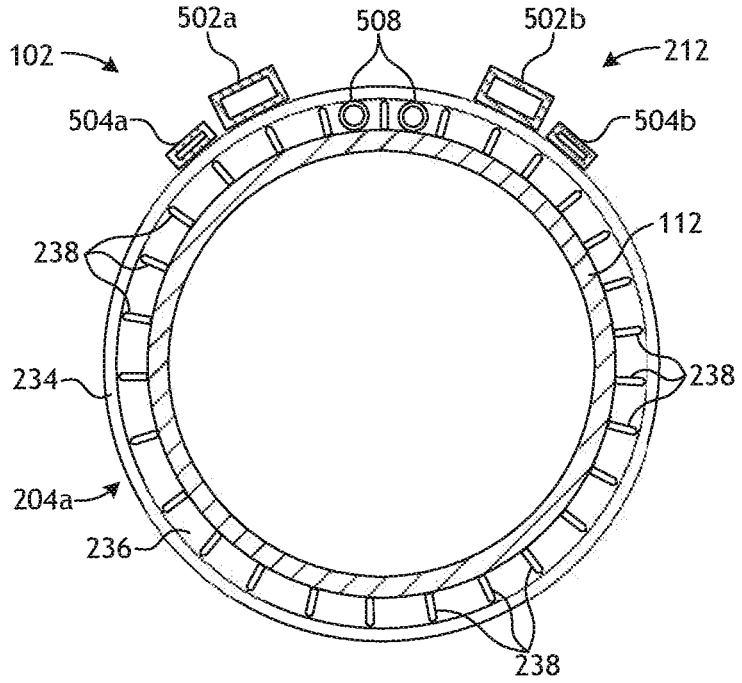
Figure 5C:
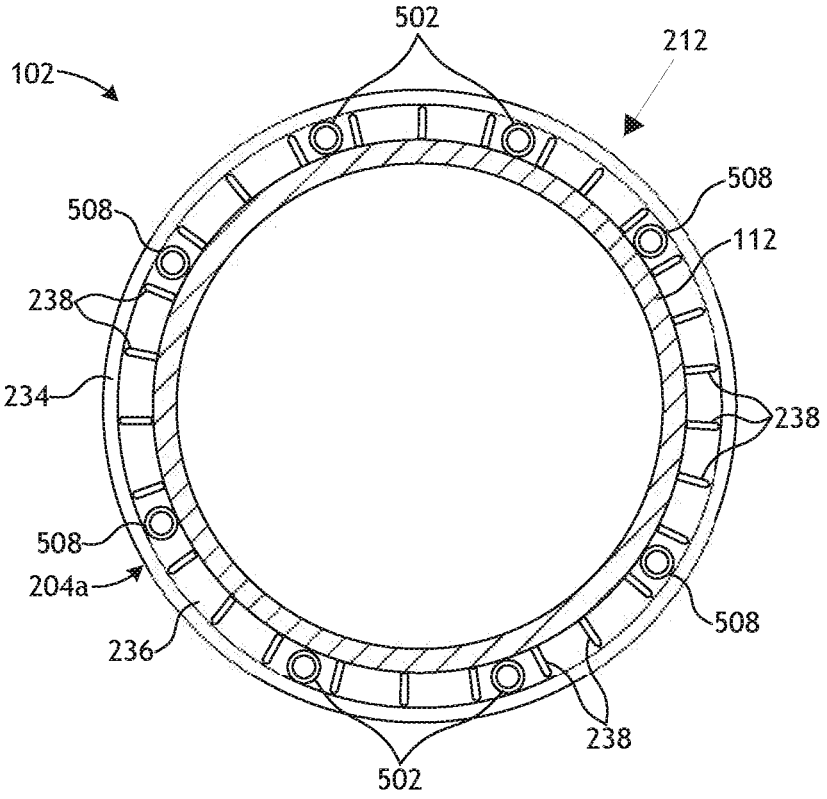

FIGS. 5A-5C are cross-sectional end views of example embodiments of the completion string 102 of FIG. 2A, according to several embodiments. Similar to FIG. 2B, in each example the first sand screen 204*a* and an upper portion of the shunt system 212 are shown. The first sand screen 204*a* includes the wire 234 wrapped about the circumference of the base pipe 112, and the ribs 238 help define the flow annulus 236 between the base pipe 112 and the wire 234.

In FIG. 5A, the shunt system 212 is depicted as including a first transport tube 502*a*, a first packing tube 504*a* associated with the first transport tube 502*a*, a second transport tube 502*b*, a second packing tube 504*b* associated with the second transport tube 502*a*, and a return tube 506. The first and second transport tubes 502*a,b* may be similar to the transport tubes 214 of FIG. 2A, the first and second packing tubes 504*a,b* may be similar to the packing tubes 218 of FIG. 2A, and the return tube 506 may be similar to the return tube 224 of FIG. 2A. Accordingly, the first and second transport tubes 502*a,b*, the packing tubes 504*a,b*, and the return tube 506 may be best understood with reference to the discussion of FIG. 2A. In the illustrated embodiment, the return tube 506 exhibits a generally crescent, kidney-shaped, or oblong cross-sectional shape. The curved dimensions of the return tube 506 about the circumference of the sand screen 204*a* may prove advantageous in maximizing the volumetric flow rate through the return tube 506 and otherwise maximize use of the limited downhole real estate.

In FIG. 5B, the shunt system 212 is depicted as including the first and second transport tubes 502*a,b* and the packing tubes 504*a,b*. The shunt system 212 of FIG. 5B, however, includes at least one return tube 508 (two shown) positioned beneath the sand screen 204*a* and interposing the sand screen 204*a* and the base pipe 112 within the flow annulus 236. Fluid 132 (FIG. 2A) from the gravel pack slurry 130 (FIG. 2A) may be able to flow into the return tube(s) 508 by first passing through the sand screen 204*a*. The return tube(s) 508 may also be configured and otherwise designed to avoid and bypass the flow control modules 208 (FIGS. 2A and 2C). This can be done, for example, by having the return tube(s) 508 fluidly connected through a flow chamber provided at each screen joint.

While only two return tubes 508 are shown in FIG. 5B extending within the flow annulus 236, it will be appreciated that more or less than two may be employed, without departing from the scope of the disclosure. This embodiment may prove advantageous in maximizing the limited downhole space or real estate. Moreover, with the return tube(s) 508 placed within the flow annulus 236, the openings 230 (FIG. 2A) in the return tube(s) 508 could be much larger since filtration of the fluid 132 (FIGS. 2A, 2C, and 2D would initially be done by the associated sand screen.

In FIG. 5C, the shunt system 212 is positioned entirely or almost entirely beneath the sand screen 204*a* and interposing the sand screen 204*a* and the base pipe 112 within the flow annulus 236. More particularly, the shunt system 212 is depicted as including a plurality of transport tubes 502 (four shown) and a plurality of return tubes 508 positioned between angularly adjacent ribs 238 and running axially along the exterior of the base pipe 112 within the flow annulus 236. Again, the fluid 132 (FIG. 2A) may be able to flow into the return tubes 508 by first passing through the sand screen 204*a*, and the return tubes 508 may also avoid and otherwise bypass the flow control modules 208 (FIGS. 2A and 2C). Similar to the embodiment of FIG. 5B, this embodiment may prove advantageous in maximizing the limited downhole space or real estate. Moreover, the embodiments of FIGS. 5B and 5C can employ round subbing in the shunt system 212, which allows for higher pressure ratings.

Figure 6A:
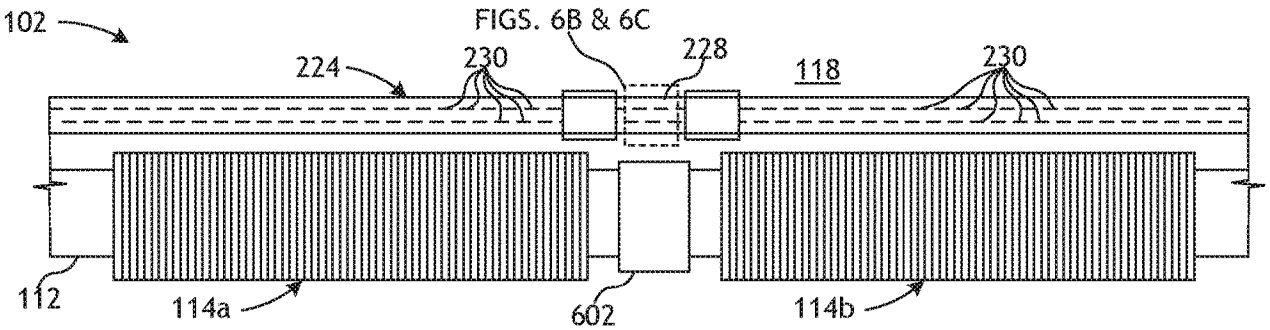
FIG. 6A is a plan view of a portion of the completion string of FIG. 2A.

FIG. 6A is a plan view of an example embodiment of the completion string 102 of FIG. 2A, according to one or more embodiments. As illustrated, the first and second sand control screen assemblies 114*a,b* are separated axially by a coupling 602. The coupling 602 may comprise, for example, a threaded collar or threaded box-and-pin engagement between upper and lower portions of the base pipe 112. Also illustrated is the return tube 224, including the jumper tube 228 that structurally and fluidly couples axially adjacent (i.e., upper and lower) portions of the return tube 224. The openings 230 are shown defined in the return tube 224 (including the jumper tube 228) along at least a portion of its axial length.

After gravel packing the annulus 118 surrounding the completion string 102, the return tube 224 effectively provides a conduit that can provide a flow path for production fluids (e.g., oil, gas, etc.). For instance, production fluids from highly productive zones could utilize this flow path, which may reduce the efficiency of the flow control devices 116 (FIG. 2C) meant to smooth the production profile. Accordingly, the return tube 224 may include one or more restriction or closure features that are operable to restrict or prevent fluid flow through all or a portion of the return tube 224.

Figure 6B:
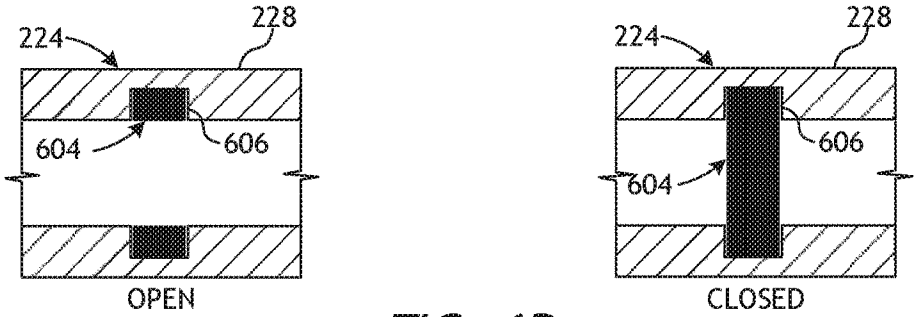
FIG. 6B is an enlarged cross-sectional view of the return tube as indicated at the dashed box in FIG. 6A.

FIG. 6B, for example, is an enlarged cross-sectional view of the return tube 224 as indicated at the dashed box in FIG. 6A and shows one example closure feature 604, according to one or more embodiments. More specifically, FIG. 6B shows the closure feature 604 in an open state, as shown in the left drawing, and a closed (restrictive) state, as shown in the right drawing. While shown positioned within the jumper tube 228, the closure feature 604 could alternatively be positioned within any portion of the return tube 224, without departing from the scope of the disclosure. Moreover, while only one is depicted, more than one closure feature 604 may be included in the return tube 224. Separate closure features 604, for example, may be included and otherwise positioned in some or all of the jumper tubes 228 along the length of the return tube 224 or in any other portion of the return tube 224.

In the illustrated embodiment, the closure feature 604 comprises a swellable material disposed within a recess 606 defined on the inner wall of the return tube 224. The swellable material may be made of, but is not limited to, a polymer, an elastic polymer, an oil-swellable polymer (e.g., an oil-swellable elastomer or oil-swellable rubber), hydrophilic monomers, hydrophobically modified hydrophilic monomers, a salt polymer, an elastomer, a rubber, and any combination thereof. In some embodiments, the swellable material may comprise a material that swells upon contact with an activating fluid, which may be any fluid to which the swellable material responds by expanding. The activating fluid may comprise, for example, but is not limited to, a hydrocarbon (i.e., oil), water, a brine, a gas, or any combination thereof. In other embodiments, however, the swellable material may be configured to expand or swell in response to a predetermined wellbore pressure, temperature, mechanical/hydraulic/electronic actuation mechanism, etc.

In at least one embodiment, the swellable material is configured to react by swelling once coming into contact with oil flowing within the return tube 224. Until oil begins to circulate through the return tube 224, the closure feature 604 will remain in an unswelled state or configuration (i.e. the open state), as shown in the left side drawing of FIG. 6B. However, once oil begins to contact the swellable material, the closure feature 604 will swell and otherwise expand radially to a swelled state or configuration (i.e., the closed/restrictive state), as shown in the right side drawing of FIG. 6B. Consequently, prior to swelling to the swelled state, fluid flow through the return tube 224 will be allowed, but after the swellable material has swelled to the swelled state, fluid flow through the return tube 224 will be restricted or substantially prevented. While the closure feature 604 is shown in FIG. 6B entirely closing off the interior of the return tube 224, it will be appreciated that the closure feature 604 may alternatively be configured to only partially close off the interior of the return tube 224 and thereby only partially restrict fluid flow therethrough.

In some applications, the completion string 102 (FIG. 6A) may be run into the open hole wellbore 104 (FIG. 1) filled with an oil-based mud. In such applications, swelling of the closure feature 604 may commence prior to the gravel packing operation. The particular swellable material, however, may be selected such that the closure feature 604 will not swell to the closed (restrictive) state until after the gravel packing operation is complete.

Figure 6C:
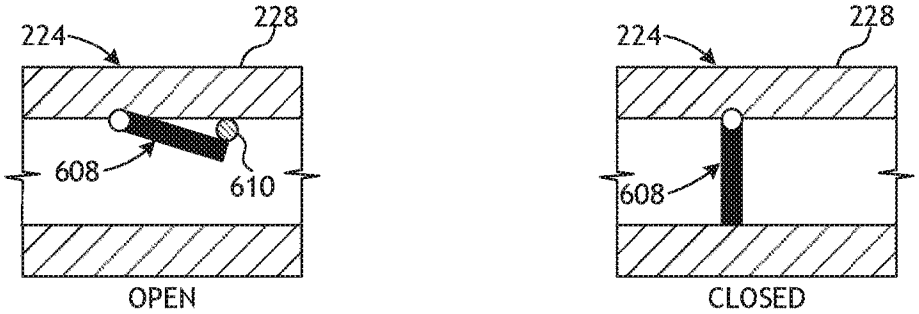
FIG. 6C is another enlarged cross-sectional view of the return tube as indicated at the dashed box in FIG. 6A.

FIG. 6C is an enlarged cross-sectional view of the return tube 224 as indicated at the dashed box in FIG. 6A and shows another example closure feature 608, according to one or more embodiments. More specifically, FIG. 6C shows the closure feature 608 in an open state, as shown in the left drawing, and a closed (restrictive) state, as shown in the right drawing. Again, while the closure feature 608 is shown positioned within the jumper tube 228, the closure feature 608 could alternatively be positioned within any portion of the return tube 224, without departing from the scope of the disclosure.

In the illustrated embodiment, the closure feature 608 comprises a valve that is movable between an open position (i.e., on the left) and a closed position (i.e., on the right). When the valve is in the open state, fluid flow through the return tube 224 will be allowed, but once the valve moves to the closed state, fluid flow through the return tube 224 will be substantially prevented. The valve may comprise a variety of fluid flow valves including, but not limited to, a check valve and a flapper valve. In the illustrated embodiment, the closure feature 608 is depicted as a flapper valve. Moreover, while the flapper-type closure feature 608 is shown in FIG. 6C entirely closing off the interior of the return tube 224, it will be appreciated that the closure feature 604 may alternatively be configured to only partially close off the interior of the return tube 224 and thereby only partially restrict fluid flow therethrough.

As illustrated, the flapper valve may be maintained in the open position using a dissolvable or degradable material 610. Suitable degradable materials 610 that may be used in the closure feature 608 include borate glass, a degradable polymer (e.g., polyglycolic acid (PGA), polylactic acid (PLA), etc.), a degradable rubber, a galvanically-corrodible metal, a dissolvable metal, a dehydrated salt, and any combination thereof. The degradable material 610 may be configured to degrade by a number of mechanisms including, but not limited to, swelling, dissolving, undergoing a chemical change, electrochemical reactions, undergoing thermal degradation, or any combination of the foregoing.

Once the degradable material 610 dissolves or otherwise allows the flapper valve to detach from the inner wall of the return tube 224, the flapper valve may be biased to the closed state, such as through the use of a torsion spring or the like. Moreover, as with the closure feature 604 of FIG. 6B, a separate closure feature 608 may be included and otherwise positioned in some or all of the jumper tubes 228 along the length of the return tube 224.

Embodiments disclosed herein include:

A. A downhole sand control completion system that includes a completion string extendable within a wellbore and including one or more sand control screen assemblies arranged about a base pipe, each sand control screen assembly including one or more sand screens positioned about the base pipe, a shunt system positioned about an exterior of the base pipe to receive and redirect a gravel slurry flowing in an annulus defined between the completion string and a wellbore wall, and a return tube positioned about the exterior of the base pipe and extending longitudinally along a portion of the completion string, the return tube defining a plurality of openings to receive a portion of a fluid in the annulus into the return tube to be conveyed into an interior of the base pipe via the return tube.

B. A method that includes introducing a gravel slurry into an annulus defined between a completion string and a wellbore wall, the completion string including one or more sand control screen assemblies arranged about a base pipe and each sand control screen assembly including one or more sand screens positioned about the base pipe, receiving and redirecting a portion of the gravel slurry in a shunt system positioned about an exterior of the base pipe, drawing a portion of a fluid in the annulus into a return tube positioned about the exterior of the base pipe and extending longitudinally along a portion of the completion string, the return tube defining a plurality of openings to receive the portion of the fluid into the return tube, flowing the portion of the fluid within the return tube, and conveying the portion of the fluid from the return tube into an interior of the base pipe.

Each of embodiments A and B may have one or more of the following additional elements in any combination: Element 1: wherein at least one of the one or more sand control screen assemblies further includes a flow control device that regulates a flow of another portion of the fluid into the interior of the base pipe via the one or more sand screens. Element 2: wherein the flow control device comprises an inflow control device, an autonomous inflow control device, or an inflow control valve. Element 3: wherein the return tube has a first end and a second end opposite the first end, and wherein the first end is positioned uphole from the one or more sand screens and the second end is positioned downhole from the one or more sand screens. Element 4: wherein the fluid comprises a carrier fluid from a gravel slurry and wherein the plurality of openings are sized to allow the carrier fluid to flow therethrough but prevent passage of particulate matter of a predetermined size included in the gravel slurry. Element 5: wherein the completion string includes a completion end and the return tube is fluidly coupled to the completion end at a return port defined in the base pipe. Element 6: further comprising an isolation sleeve positioned within the base pipe and movable between a closed position, where the isolation sleeve occludes the return port, and an open position, where the isolation sleeve is moved to expose the return port. Element 7: wherein the return tube terminates at an intermediate location between upper and lower ends of the completion string. Element 8: further comprising a sacrificial screen positioned about the base pipe at a completion end of the completion string, wherein the return tube feeds the portion of the fluid to the sacrificial screen, and an isolation plug positioned within the base pipe and movable between a first position, where the portion of the fluid is able to circulate into the base pipe through the sacrificial screen, and a second position, where sacrificial screen is isolated. Element 9: wherein the return tube exhibits a cross-sectional shape selected from the group consisting of circular, polygonal, crescent, oval, ovoid, and any combination there. Element 10: wherein the return tube is positioned within a flow annulus defined between the one or more sand screens and the exterior of the base pipe. Element 11: wherein the shunt system and the return tube are positioned within a flow annulus defined between the one or more sand screens and an exterior of the base pipe. Element 12: further comprising a closure feature positioned within the return tube and operable to restrict fluid flow through the return tube. Element 13: wherein the closure feature comprises one of a swellable material and a valve.

Element 14: wherein at least one of the one or more sand control screen assemblies further includes a flow control device, the method further comprising drawing a second portion of the fluid through the one or more sand screens and into the flow control device, and regulating a flow of the second portion of the fluid into the interior of the base pipe with the flow control device. Element 15: wherein the fluid comprises a carrier fluid from a gravel slurry and the plurality of openings are sized to allow the carrier fluid to flow therethrough, the method further comprising preventing passage of particulate matter of the gravel slurry through the plurality of openings. Element 16: wherein the completion string includes a completion end and the return tube is fluidly coupled to the completion end at a return port defined in the base pipe and wherein conveying the portion of the fluid from the return tube into the interior of the base pipe comprises discharging the portion of the fluid into the interior via the return port. Element 17: wherein an isolation sleeve is positioned within the base pipe at the completion end, the method further comprising moving the isolation sleeve to a closed position and thereby occluding the return port and ceasing a flow of the portion of the fluid into the interior via the return tube. Element 18: wherein conveying the portion of the fluid from the return tube into the interior of the base pipe further comprises discharging the portion of the fluid from the return tube via one or more discharge ports defined in the return tube, drawing the portion of the fluid discharged from the return tube into a sacrificial screen positioned about the base pipe at a completion end of the completion string, and regulating a flow of the portion of the fluid into the interior of the base pipe with an isolation plug positioned within the base pipe. Element 19: further comprising moving the isolation plug to within the base pipe and thereby isolating the sacrificial screen. Element 20: wherein the return tube includes a closure feature positioned therein, the method further comprising preventing fluid flow through the return tube with the closure feature.

By way of non-limiting example, exemplary combinations applicable to A and B include: Element 1 with Element 2; Element 5 with Element 6; Element 12 with Element 13; Element 16 with Element 17; and Element 18 with Element 19.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A downhole sand control completion system, comprising:

a completion string extendable within a wellbore and including one or more sand control screen assemblies arranged about a base pipe, each sand control screen assembly including one or more sand screens positioned about the base pipe;

a shunt system positioned about an exterior of the base pipe to receive and redirect a gravel slurry flowing in an annulus defined between the completion string and a wellbore wall;

a return tube positioned between the completion string and the wellbore wall and extending longitudinally along a portion of the completion string, the return tube defining a plurality of openings to receive a portion of a carrier fluid flowing from the annulus into the return tube, wherein the carrier fluid is directly conveyed into an interior of the base pipe via the return tube, and wherein the return tube is configured to prevent proppant, sand, and gravel to flow through the return tube, wherein the return tube extends as a continuous conduit between a first and a second ends of the return tube; and one or more jumper tubes that fluidly couple axially adjacent portions of the return tube, wherein the one or more jumper tubes are configured to generally span an axial distance between one or more axially adjacent sand screens of the one or more sand screens.

2. The system of claim 1, wherein at least one of the one or more sand control screen assemblies further includes a flow control device that regulates a flow of another portion of the carrier fluid into the interior of the base pipe via the one or more sand screens.

3. The system of claim 2, wherein the flow control device comprises an inflow control device, an autonomous inflow control device, or an inflow control valve.

4. The system of claim 1, wherein the return tube has a first end and a second end opposite the first end, and wherein the first end is positioned uphole from the one or more sand screens and the second end is positioned downhole from the one or more sand screens.

5. The system of claim 1, wherein the completion string includes a completion end and the return tube is fluidly coupled to the completion end at a return port defined in the base pipe.

6. The system of claim 5, further comprising an isolation sleeve positioned within the base pipe and movable between a closed position, where the isolation sleeve occludes the return port, and an open position, where the isolation sleeve is moved to expose the return port.

7. The system of claim 1, wherein the return tube terminates at an intermediate location between upper and lower ends of the completion string.

8. The system of claim 1, further comprising:

a sacrificial screen positioned about the base pipe at a completion end of the completion string, wherein the return tube feeds the portion of the carrier fluid to the sacrificial screen; and an isolation plug positioned within the base pipe and movable between a first position, where the portion of the carrier fluid is able to circulate into the base pipe through the sacrificial screen, and a second position, where sacrificial screen is isolated.

9. The system of claim 1, wherein the return tube is positioned within a flow annulus defined between the one or more sand screens and the exterior of the base pipe.

10. The system of claim 1, wherein the shunt system and the return tube are positioned within a flow annulus defined between the one or more sand screens and an exterior of the base pipe.

11. The system of claim 1, further comprising a closure feature positioned within the return tube and operable to restrict fluid flow through the return tube.

12. The system of claim 11, wherein the closure feature comprises one of a swellable material and a valve.

13. A method, comprising:

introducing a gravel slurry into an annulus defined between a completion string and a wellbore wall, the completion string including one or more sand control screen assemblies arranged about a base pipe and each sand control screen assembly including one or more sand screens positioned about the base pipe;

receiving and redirecting a portion of the gravel slurry in a shunt system positioned about an exterior of the base pipe;

drawing a portion of a carrier fluid in the annulus into return tube positioned between the completion string and the wellbore wall and extending longitudinally along a portion of the completion string, the return tube defining a plurality of openings to receive the portion of the carrier fluid into the return tube, and the return tube extending as a continuous conduit between a first and a second ends of the return tube;

flowing the portion of the carrier fluid within the return tube;

preventing proppant, sand, and gravel from flowing through the return tube, wherein the return tube is configured to prevent proppant, sand, and gravel to flow through the return tube, and directly conveying the portion of the carrier fluid from the return tube into an interior of the base pipe, wherein one or more jumper tubes that fluidly couple axially adjacent portions of the return tube, and wherein the one or more jumper tubes are configured to generally span an axial distance between one or more axially adjacent sand screens of the one or more sand screens.

14. The method of claim 13, wherein at least one of the one or more sand control screen assemblies further includes a flow control device, the method further comprising:

drawing a second portion of the carrier fluid through the one or more sand screens and into the flow control device; and regulating a flow of the second portion of the carrier fluid into the interior of the base pipe with the flow control device.

15. The method of claim 13, wherein the carrier fluid is from a gravel slurry and the plurality of openings are sized to allow the carrier fluid to flow therethrough, the method further comprising preventing passage of particulate matter of the gravel slurry through the plurality of openings.

16. The method of claim 13, wherein the completion string includes a completion end and the return tube is fluidly coupled to the completion end at a return port defined in the base pipe and wherein conveying the portion of the carrier fluid from the return tube into the interior of the base pipe comprises discharging the portion of the carrier fluid into the interior via the return port.

17. The method of claim 16, wherein an isolation sleeve is positioned within the base pipe at the completion end, the method further comprising moving the isolation sleeve to a closed position and thereby occluding the return port and ceasing a flow of the portion of the carrier fluid into the interior via the return tube.

18. The method of claim 13, wherein conveying the portion of the carrier fluid from the return tube into the interior of the base pipe further comprises:

discharging the portion of the carrier fluid from the return tube via one or more discharge ports defined in the return tube;

drawing the portion of the carrier fluid discharged from the return tube into a sacrificial screen positioned about the base pipe at a completion end of the completion string; and regulating a flow of the portion of the carrier fluid into the interior of the base pipe with an isolation plug positioned within the base pipe.

19. The method of claim 18, further comprising moving the isolation plug to within the base pipe and thereby isolating the sacrificial screen.

20. The method of claim 13, wherein the return tube includes a closure feature positioned therein, the method further comprising preventing fluid flow through the return tube with the closure feature.

21. A downhole sand control completion system, comprising:

a completion string extendable within a wellbore and including one or more sand control screen assemblies arranged about a base pipe, each sand control screen assembly including one or more sand screens positioned about the base pipe;

a shunt system positioned about an exterior of the base pipe to receive and redirect a gravel slurry flowing in an annulus defined between the completion string and a wellbore wall;

a return tube positioned between the completion string and the wellbore wall and extending longitudinally along a portion of the completion string, the return tube comprising an elongated sand screen and defining a plurality of openings formed between laterally adjacent wires of the elongated sand screen and configured to receive a portion of a carrier fluid flowing from the annulus into the return tube, wherein the carrier fluid is directly conveyed into an interior of the base pipe via the return tube, and wherein the return tube is configured to prevent proppant, sand, and gravel to flow through the return tube; and one or more jumper tubes that fluidly couple axially adjacent portions of the return tube, wherein the one or more jumper tubes are configured to generally span an axial distance between one or more axially adjacent sand screens of the one or more sand screens.

* * * * *